US007481691B2

(12) United States Patent
Sze et al.

(10) Patent No.: US 7,481,691 B2
(45) Date of Patent: Jan. 27, 2009

(54) FLYING TOY FOR PROPELLER LAUNCHING

(76) Inventors: Chau King Sze, 2/F, 101 Fuk Wing Street, Shamshuipo, Kowloon (HK); Mark Chernick, 5728 NE. 71st St., Seattle, WA (US) 98115; Simeon Tiefel, 3027 SE. 131st Ave., Portland, OR (US) 97236; Webb Nelson, 9716 Lakeshore NE., Seattle, WA (US) 98115

( * ) Notice: Subject to any disclaimer, the term of this patent is extended or adjusted under 35 U.S.C. 154(b) by 342 days.

(21) Appl. No.: 11/353,404

(22) Filed: Feb. 14, 2006

(65) Prior Publication Data

US 2006/0183399 A1 Aug. 17, 2006

Related U.S. Application Data

(60) Provisional application No. 60/653,888, filed on Feb. 15, 2005.

(51) Int. Cl.
*A63H 27/127* (2006.01)
*A63H 27/00* (2006.01)

(52) U.S. Cl. ..... 446/45; 446/63; 124/26

(58) Field of Classification Search ..... 446/34–45, 446/63; 244/12.2, 23 C, 23 R, 44, 46; 124/24–27
See application file for complete search history.

(56) References Cited

U.S. PATENT DOCUMENTS 3,246,424 A 4/1966 Gregory
3,568,358 A * 3/1971 Bruce ..... 446/37
3,570,467 A * 3/1971 Belokin, Jr. ..... 124/26
4,030,238 A 6/1977 Lakin ..... 46/86
4,065,873 A * 1/1978 Jones ..... 446/37
4,204,359 A 5/1980 Plo ..... 46/83
4,781,642 A 11/1988 Stanzel ..... 446/38
5,525,086 A 6/1996 Gentile et al. ..... 446/41

* cited by examiner

*Primary Examiner*—Kien T Nguyen
(74) *Attorney, Agent, or Firm*—Ware, Fressola, Van Der Sluys & Adolphson, LLP

(57) ABSTRACT

A flying toy has a handle and a driving mechanism to spin a propeller assembly for launching, the propeller assembly having blades on the top end and a freely rotatable conical sleeve on the bottom end. The handle comprises a plurality of pinch rollers surrounding the driving mechanism such that when the driving mechanism is activated to spin the blades, the pinch rollers are moved inward to engage with the conical sleeve for holding the propeller assembly while the blades are spun, and the pinch rollers are moved away from the conical sleeve for launching the propeller assembly. The flying toy also has a landing platform affixed to the handle, the platform having a funnel-shaped receptacle to receive the bottom end of the propeller assembly. The receptacle wall has soft fins for hampering the spinning of the propeller assembly when receiving a descending propeller assembly.

10 Claims, 7 Drawing Sheets

FLYING TOY FOR PROPELLER LAUNCHING

This application is based on and claims priority to U.S. Provisional Patent No. 60/653,888, filed Feb. 15, 2005. It is also based on and claims priority to PCT/US05/05410, filed Feb. 18, 2005.

FIELD OF THE INVENTION

The present invention relates to a flying toy and, more particularly, to a flying toy having a propeller or multi-blade boomerang.

BACKGROUND OF INVENTION

A traditional hand-held flying toy uses a variety of mechanisms for simple sling action and catapult launching. Such mechanism is motor-driven or ripcord powered with bayonet coupling. After the propeller is launched, the propeller generally falls to the ground after the propelling motion can no longer support the flight. In order to re-launch the propeller, the propeller must be picked up and manually engaged with the launching mechanism.

It is desirable to provide a flying toy having a mechanism for catching the propeller in flight and launching the propeller after it has been caught.

SUMMARY OF THE INVENTION

The present invention provides a landing platform affixed to a handle of a propeller launcher so as to catch a descending propeller. The landing platform has a funnel-shaped receptacle built in the middle of the platform. The propeller launcher comprises a gearbox with inverted conical pinch rollers, a two-prong coupler fitted to a motor shaft and a power button to engage the propeller for spinning it.

The main body of the launcher body comprises two-half plastic shells, which accommodates a DC motor, one or more batteries, a gearbox assembly with a press button, and a landing platform preferably made of resilient material. The stem of the separate propeller is outfitted with a conical sleeve, which is retained by the inverted conical pinch rollers when the pinch rollers are moved inward. As such, the propeller is firmly engaged to the gearbox prior to releasing.

In accordance with the present invention, the gearbox is made up of top and bottom shells, sandwiching a freely rotating cam plate with spur gear built on the underside. A plurality of slots which depict the loci of the pinch rollers are built on both top and bottom shelves, and interact with spiral slots built on a rotary cam plate to govern the radial position of each pinch roller in full synchronization. The cam plate is driven by rack meshes to the spur gear built on a cam plate. The rack is linked to a recoiling spring on one end and a power button on the other end.

In a preferred embodiment of the present invention, a metal shaft extended downwardly from the hub of the propeller is enclosed by a conical sleeve. The sleeve is gripped by pinch rollers when closing and thus the propeller is retained in the handle.

Additionally in accordance with the invention, a swivel tip with flat-surface is affixed to the propeller hub. The swivel tip dissipates impact when the propeller hits the ceiling when it is launched vertically indoors. As a result, the propeller adheres to the ceiling for a period before gravity overcomes its self-sustaining upward thrust.

Thus, the present invention provides a flying toy comprising:

a handle;

a landing platform disposed on one side of the handle, wherein the landing platform comprises a receptacle for accommodating a propeller assembly. The receptacle has a funnel-shaped wall and a plurality of fins distributed around the wall.

According to the present invention, the flying toy is operable in a first mode to launch the propeller assembly off the landing platform while the propeller assembly is located in the receptacle, and in a second mode to receive the propeller assembly into the receptacle while the propeller assembly is in flight with a spinning motion, and wherein the fins are made of a shock absorbent material so that when the flying toy is operated in the second mode, the fins hamper a force associated with the spinning motion while the propeller assembly is received into the receptacle.

According to the present invention, the propeller assembly has a first end, an opposing second end and a shaft connecting the first end to the second end, the shaft defining a spinning axis of the spinning motion, the first end having a plurality of blades to produce a propeller action in air associated with the spinning motion in order to maintain the propeller assembly in the air. The second end has an end coupler fixedly attached to the shaft, and a sleeve disposed over the end coupler, the sleeve independently rotatable relative to the shaft, and wherein the handle comprises a driving mechanism adapted to engage with the end coupler of the propeller assembly through the receptacle so that the driving mechanism causes the blades to spin when the flying toy is operated in the first mode.

According to the present invention, the sleeve of the propeller assembly has a conical shape, and the driving mechanism comprises a driving coupler for providing mechanical coupling between the driving mechanism and the end coupler of the propeller assembly so as to cause the blades to spin when the driving mechanism is activated; and the handle further comprises a plurality of pinch rollers positioned in relationship to the driving coupler, the pinch rollers movable between a first position and a second position, such that when the driving mechanism is activated to cause the blades to spin through the coupling between the end coupler and the driving coupler, the pinch rollers are moved into the first position to engage with the conical sleeve in order to keep the propeller assembly in a stable position while the blades are spinning, and when the propeller assembly is ready to be launched, the pinch rollers are moved to the second position, allowing the propeller assembly to disengage from the driving mechanism and the landing platform.

In a different embodiment of the present invention, the flying toy comprises:

a launching handle;

a driving mechanism disposed on the launching handle, the driving mechanism having a driving coupler adapted to engage with the end coupler of the propeller assembly for causing the blades to spin when the driving mechanism is activated;

a plurality of pinch rollers disposed on the launching handle around the driving coupler, the pinch rollers movable between a first position and a second position such that when the driving mechanism causes the blades to spin through the driving coupler, the pinch rollers are moved into the first position to engage with the conical-shaped sleeve in order to keep the propeller assembly in a stable position while the blades are spinning, and when the propeller assembly is ready to be launched, the pinch rollers are moved to the second position away from the conical-shaped sleeve, allowing the propeller assembly to disengage from the driving mechanism and the launching handle.

According to the present invention, the flying toy further comprises:

a gear box having a first cover and a second cover, each cover having a plurality of linear slots accommodating the plurality of pinch rollers to allow the pinch rollers to move between the first position and the second position; and a cam plate disposed in the gear box between the first cover and the second cover, the cam plate having a plurality of spiral shaped slots interacting with the linear slots, the cam plate having a home position, the plurality of pinch rollers disposed in the linear slots through the spiral shaped slots such that the pinch rollers are located at the second position when the cam plate is at the home position; and a rack movable between a first rack position for activating the driving mechanism and a second rack position for deactivating the driving mechanism, the rack coupled to the cam plate such that when the rack is moved from the second rack position to the first rack position, it causes the cam plate to rotate away from the home position, forcing the pinch rollers to move into the first position, and when the rack is moved from the first rack position back to the second position, it allows the cam plate to return to the home position and moves the pinch rollers to the second position.

The present invention will become apparent upon reading the description taken in conjunction with FIGS. 1*a*-6.

DETAILED DESCRIPTION OF THE INVENTION

Figure 1A:
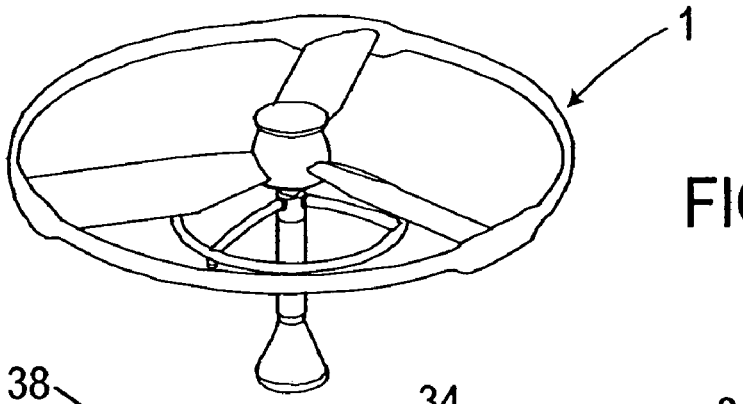
FIG. 1*a* shows a propeller assembly.
Figure 1B:
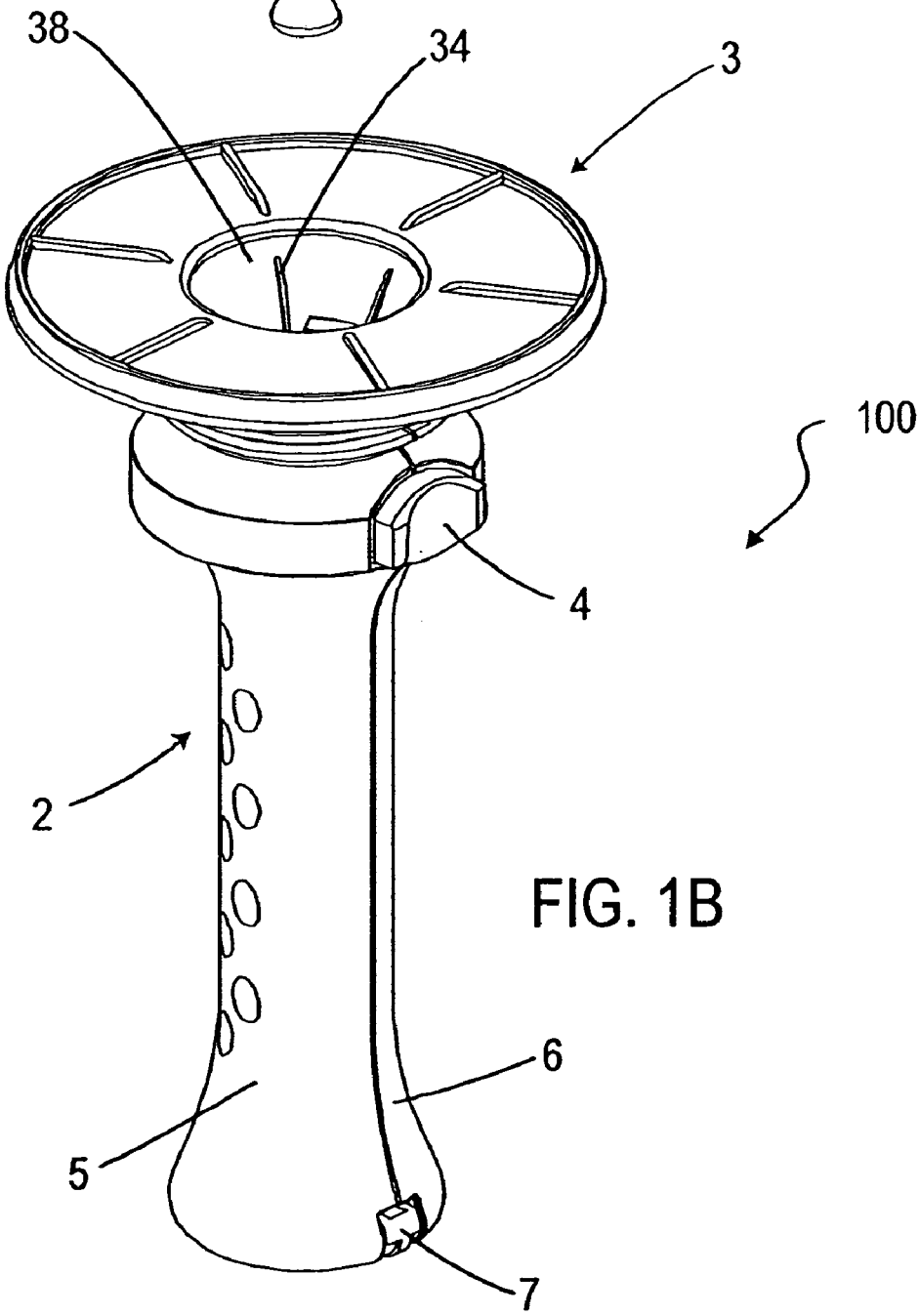
FIG. 1*b* shows a propeller launcher, according to the present invention.
Figure 2A:
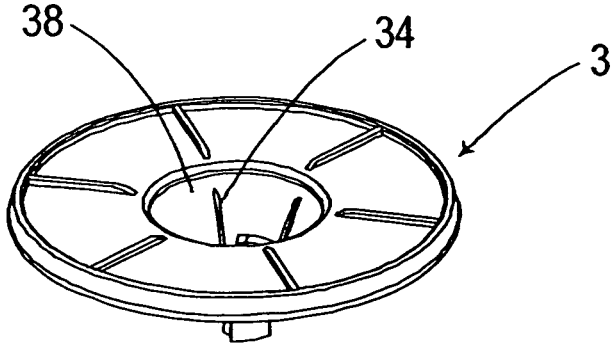
FIG. 2*a* shows a landing platform for use in the propeller launcher, according to the present invention.
Figure 2B:
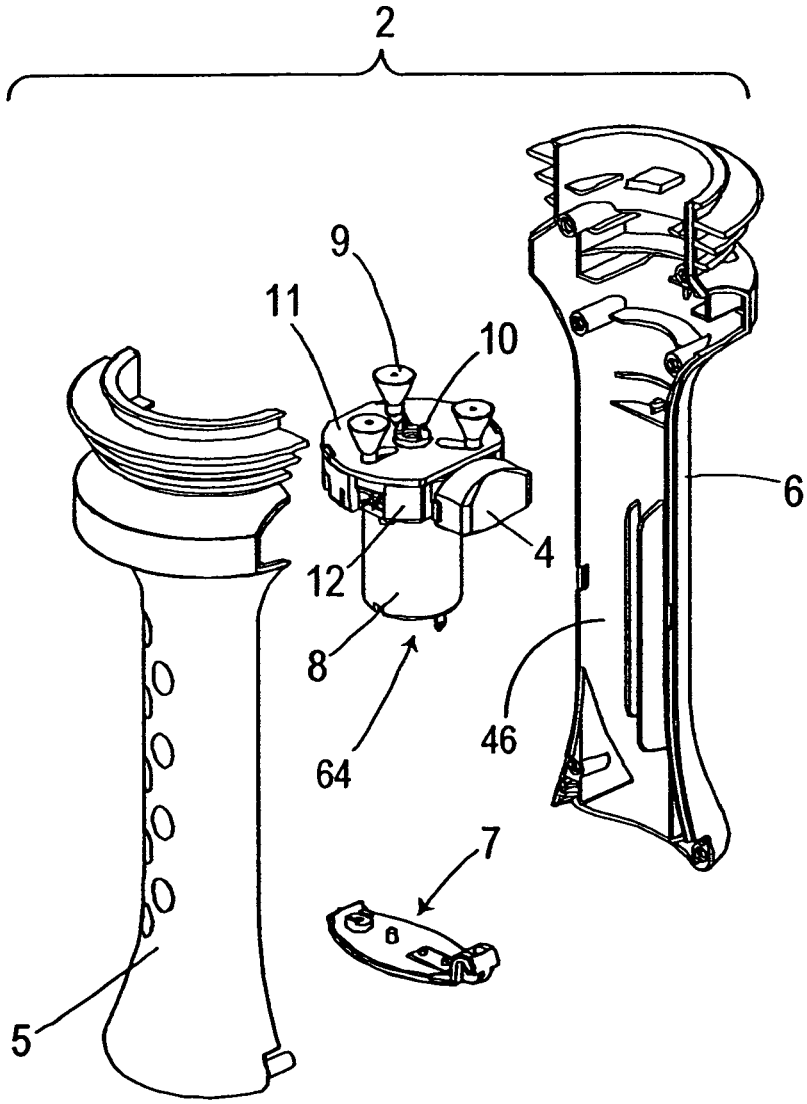
FIG. 2*b* is an exploded view of the launcher handle, according to the present invention.

Reference is made to FIGS. 1*a* to 2*b*, which illustrate a flying toy according to a preferred embodiment of the present invention. FIG. 1*a* shows a propeller assembly 1 that can be used with a launcher 100, as shown in FIG. 1*b*. The launcher 100 comprises a handle 2 made of two half shells 5 and 6 and a battery cover 7 disposed at the bottom of the handle 2. As shown in FIG. 1*b*, the launcher 100 further comprises a landing platform 3 disposed on top of the handle 2 and a power button 4 below to the landing platform 3. Preferably the landing platform 3 is made of a resilient material. As shown in FIG. 2*a*, the landing platform 3 has a funnel-shaped receptacle 38 in the center of the platform so as to catch and to accommodate a propeller assembly 1. A plurality of fins 34 distributed over the inner wall of the funnel-shaped receptacle 38 in order to reduce the shock caused by the centrifugal force of a spinning propeller. As shown in FIG. 2*b*, the handle 2 has a gearbox assembly 64, a battery chamber 46 and a battery cover 7. The gearbox assembly 64 comprises of a plurality of inverted conical pinch rollers 9 distributed in respective radial positions, a DC motor 8 and a power button 4 extending outwardly. The power button 4 is positioned below the receptacle 38. A two-prong driving coupler 10 is disposed on top of the gearbox assembly 64.

Figure 3A:
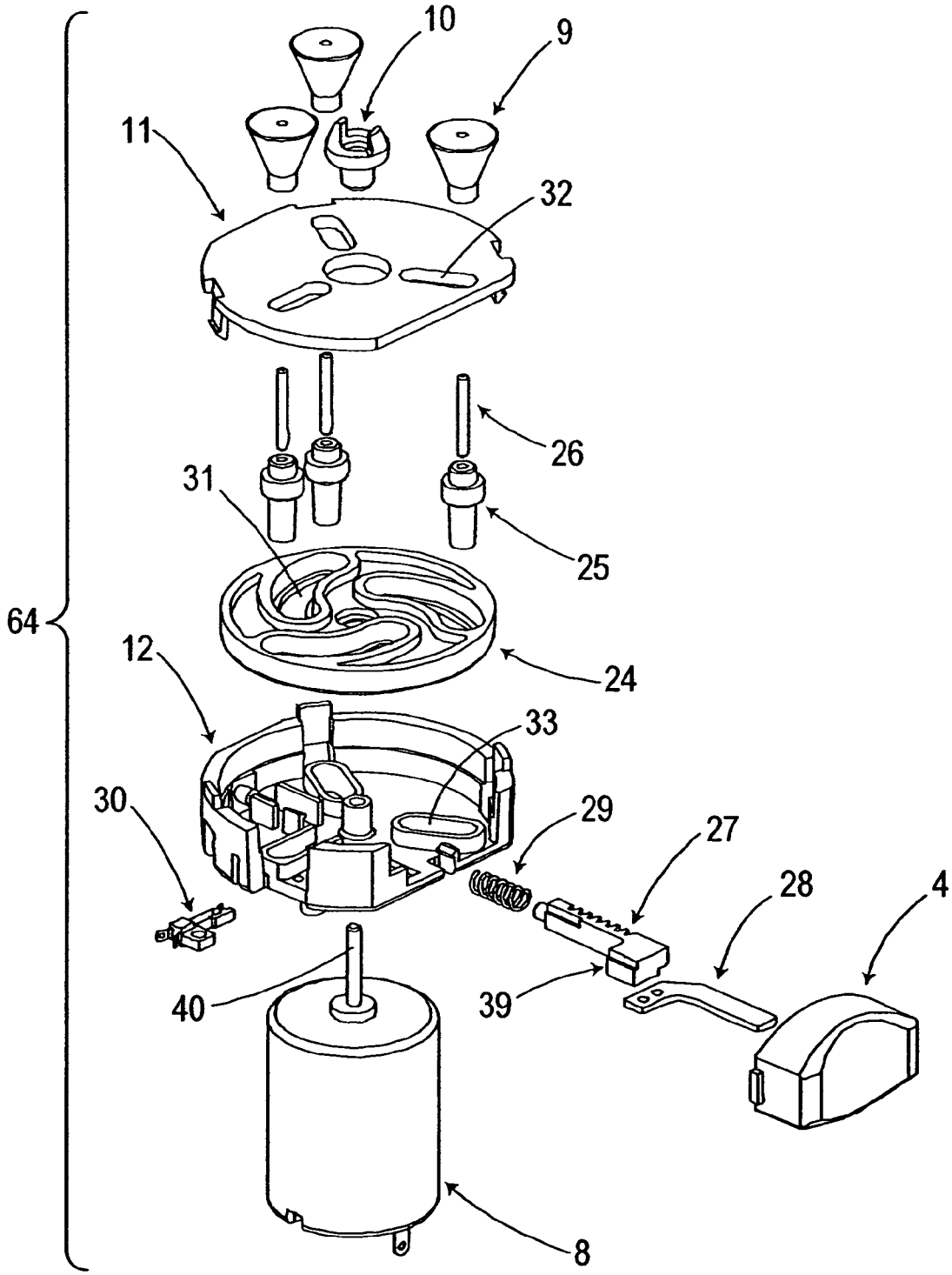
FIG. 3*a* is an exploded view of the gearbox assembly.
Figure 3B:
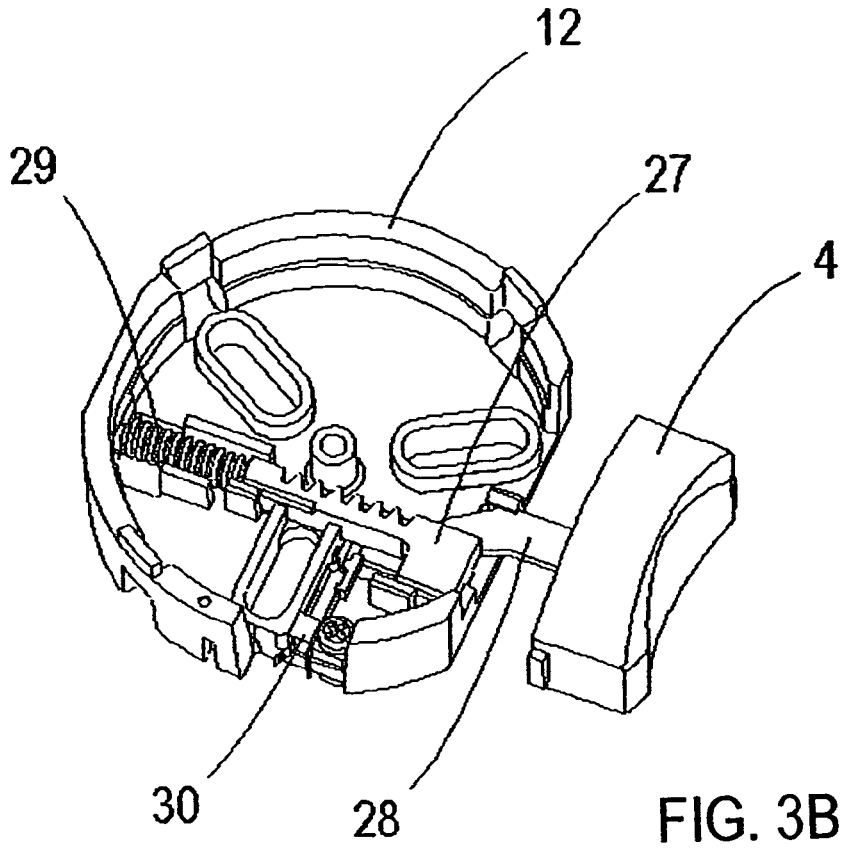
FIG. 3*b* shows the lower half of the gearbox assembly.
Figure 3C:
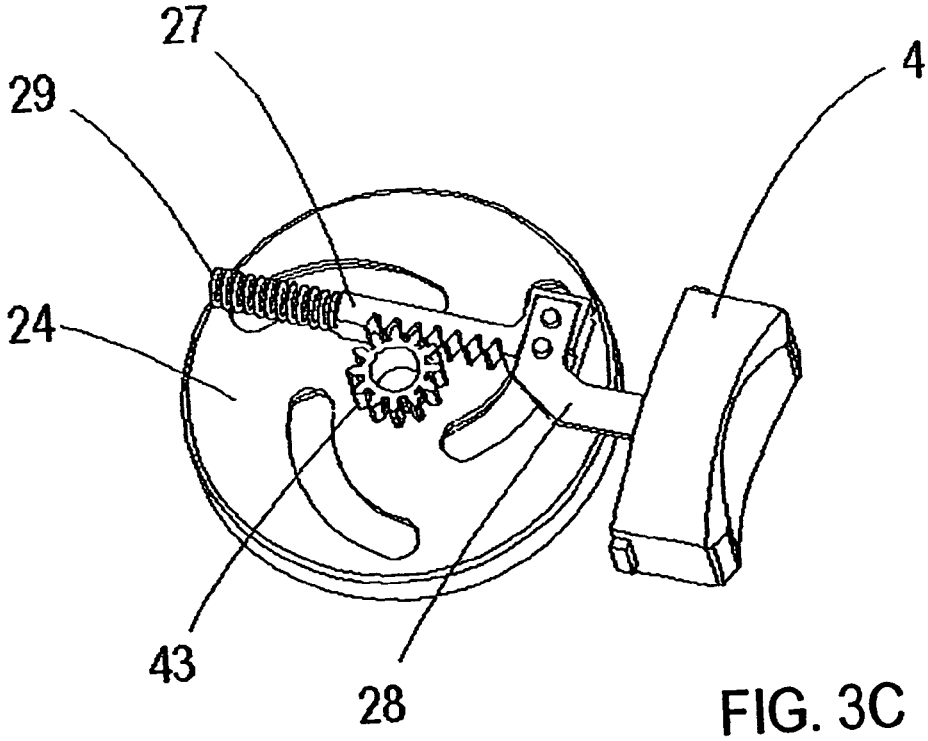
FIG. 3*c* is a bottom view of the cam plate showing a spur gear meshed to a rack.

FIGS. 3*a*-3*c* shows the exploded views of the gearbox assembly 64 and some components associated with the gearbox assembly. As shown, the gearbox assembly 64 comprises a rotary cam plate 24, sandwiched between a top cover 11 and a bottom cover 12. The top cover 11 has a plurality of linear slots 32 disposed in a radial arrangement. The bottom cover 12 also has a plurality of matching linear slots 33. These linear slots 32, 33 confine the path of each inverted conical pinch roller 9 when the pinch rollers are moved inward before a propeller is launched. The cam plate 24 has a plurality of spiral slot 31 whereupon is seated a bushing 25 adjoined to the pinch roller 9 by means of a knurled shaft 26. A rack 27 meshes to a rooted spur gear 44 on the bottom section of the cam plate 24. One end of the rack 27 is connected to a power button 4 by a metal linkage 28. A recoiling spring 29 is deployed on the other end of the rack 27. In operation, when the power button 4 is pressed, it drives the cam plate 24 into rotation and forces the pinch roller 9 to move inward along the linear slots 32, 33. A leaf switch 30 is disposed on the moving path of rack 27 such that when the rack 27 travels transversely, the leaf switch 30 is triggered by a stepped shoulder 39 built on one side of the rack 27. The leaf switch 30 is used to activate a DC motor 8. The DC motor 8 comprises a motor shaft 40 fitted through the bottom cover 12, the cam plate 24 and the top cover 11. The end portion of the motor shaft 40 is press-fitted with the two-prong coupler 10.

Figure 4:
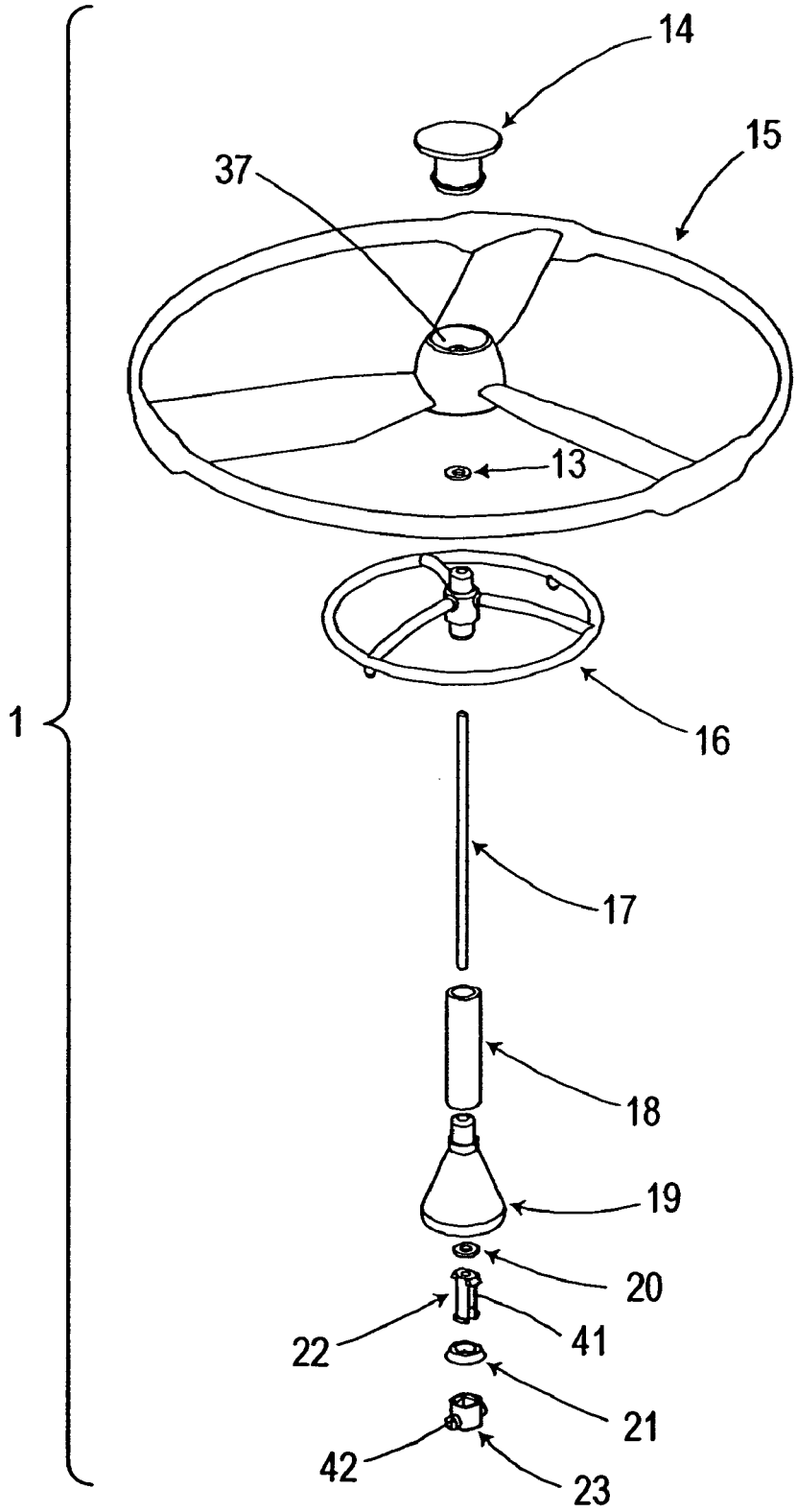
FIG. 4 is an exploded view of the propeller assembly.

FIG. 4 shows an exploded view of the propeller assembly according to the present invention. As shown, a multi-blade propeller 15 is fitted with a freely swivel tip 14 in the hub 37. A steel shaft 17 is inserted through a register ring 16 and is permanently fixed to the multi-blade propeller 15 with a nylon washer 13 in between. The register ring 16 is further connected to a conical sleeve 19 by means of a tube 18. The register ring 16, the tube 18 and the conical sleeve 19 come into being one embodiment, yet are free to rotate independently of the multi-blade propeller 15. On the other end of steel shaft 17, a nylon washer 20 and a retaining plug 22 with two flat surfaces 41 are located. Further affixed to the retaining plug 22, are a slave coupler 23 with two studs 42 positioned oppositely and a soft washer 21 in between to reduce any shock that may arise. The slave coupler 23 is allowed to rotate freely within certain angular movements in respect to the retaining plug 22.

Figure 5:
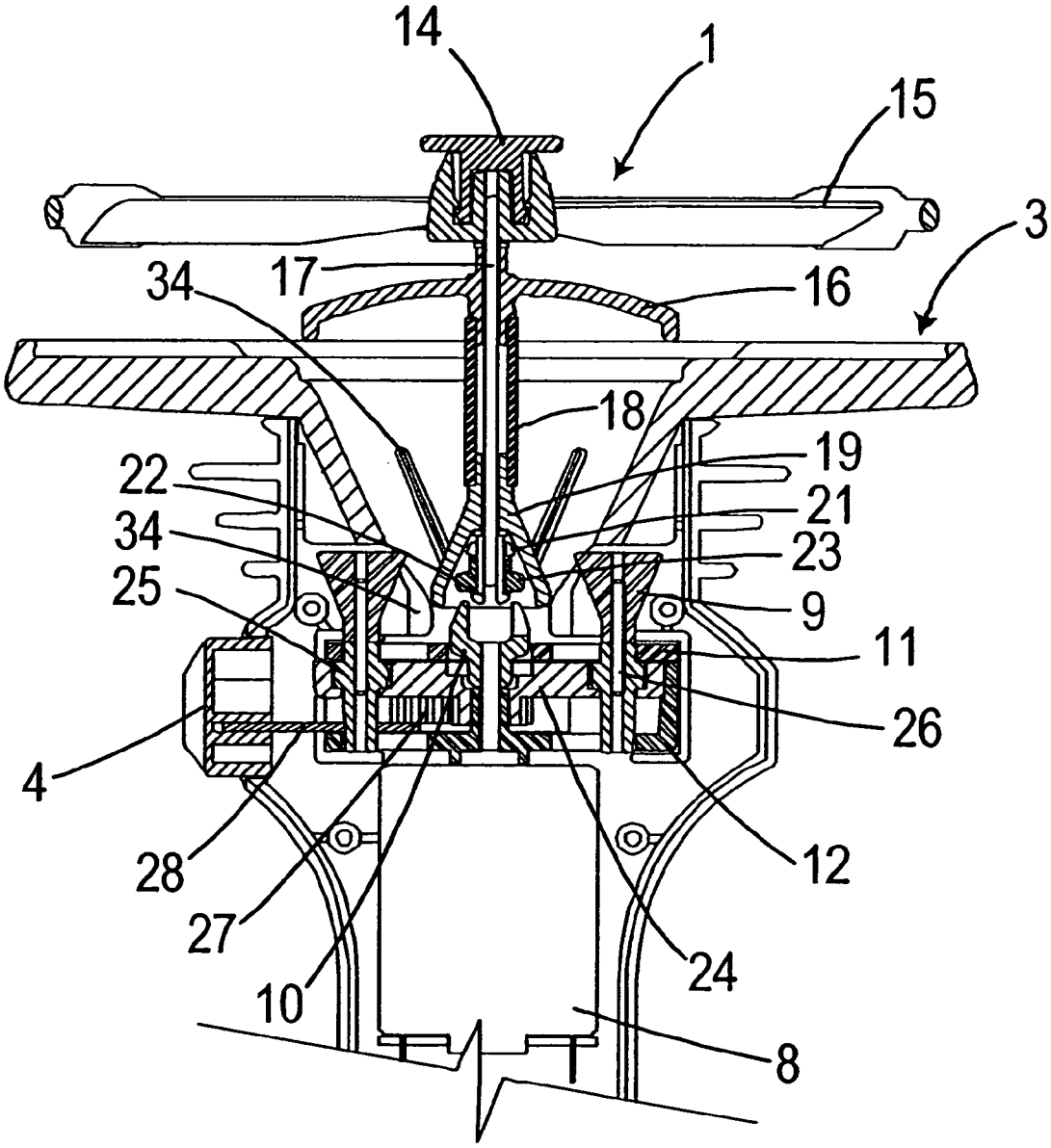
FIG. 5 is a cross section view of the propeller assembly being halfway seated in the platform before it is fully engaged.
Figure 6:
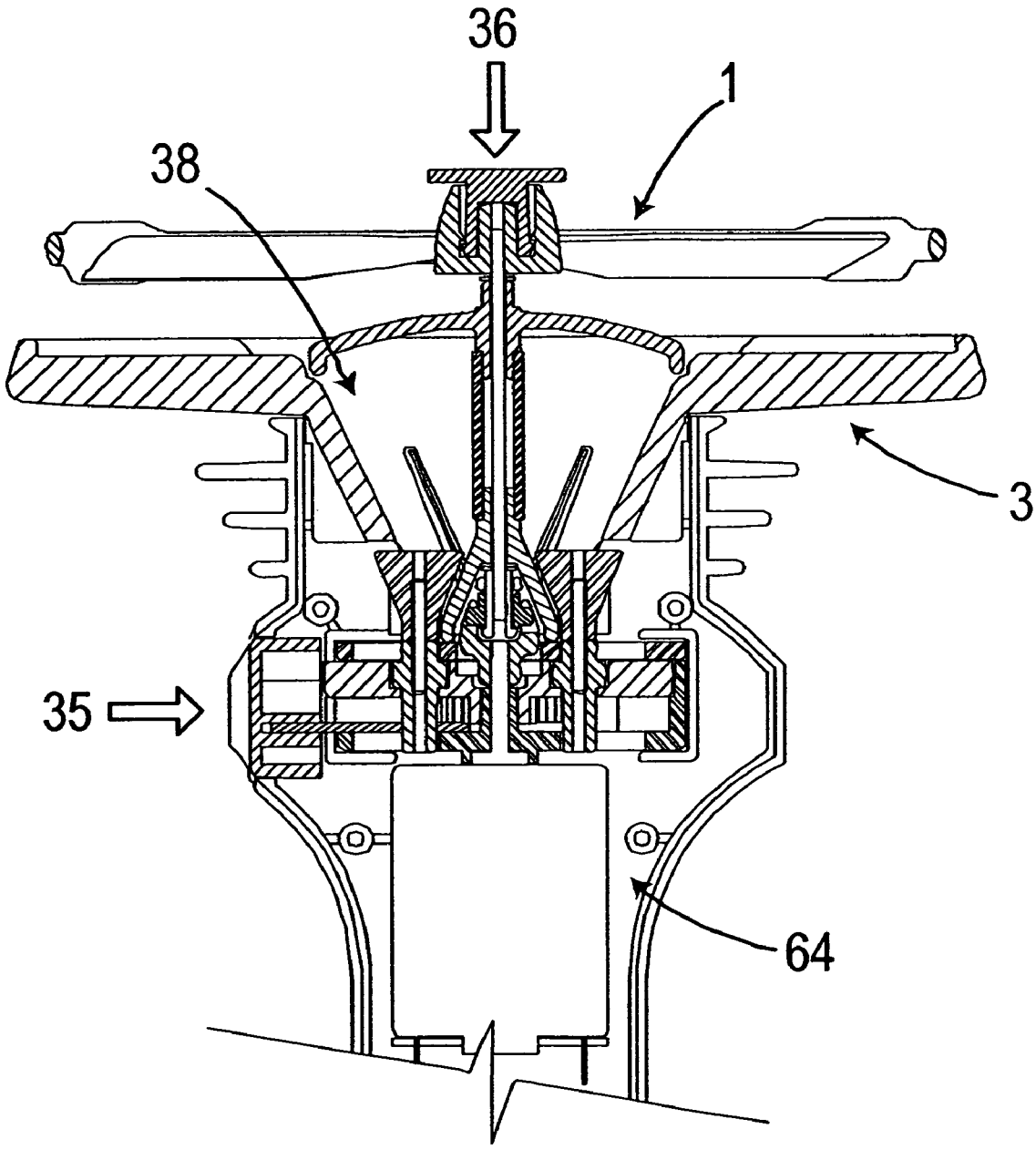
FIG. 6 is a cross section view of the propeller assembly being fully engaged in the launcher.

Reference is now made to FIG. 5 and FIG. 6, particularly to FIG. 5 which illustrates the propeller assembly 1 being caught with the receptacle 38 (by a user. As it is halfway seated in the receptacle 38 of the landing platform 3, the propeller assembly 1 is restrained by the soft fins 34 built around the funnel-shaped receptacle 38 before it comes to engage with a driving coupler 10.

In the process of launching, the power button 4 is pressed inward along the direction 35, causing the pinch rollers 9 to converge in order to grip the conical sleeve 19 of the propeller assembly 1, and to pull the propeller assembly 1 further downward in the direction 36. As such, the slave coupler 23 is engaged with the driving coupler 10. Such arrangement provides buffering between the propeller assembly 1 and the receptacle 38. At the same time, the arrangement minimizes the possibility of a descending propeller to bounce off the receptacle 38 because of the collision between the spinning coupler 23 of the propeller assembly 1 and the driving coupler 10 of the gearbox assembly 64 (see FIG. 2*b*). In addition, the register ring 16, properly seated in the opening of the funnel-shape receptacle 38, helps maintaining an upright, non-swaying rotating axis of the propeller 1 when the propeller assembly 1 is spun upward.

In sum, according to the present invention, the flying toy has a handle and a driving mechanism to spin a propeller assembly, the propeller assembly having blades on the top end and a freely rotatable conical sleeve on the bottom end. In one embodiment of the present invention, a landing platform is provided on the top of the handle, the landing platform comprises a receptacle to accommodate the propeller assembly. The flying toy is operable in a first mode to launch the propeller assembly off the landing platform while the propeller assembly is located in the receptacle, and in a second mode to receive the propeller assembly into the receptacle while the propeller assembly is in flight with a spinning motion, and wherein the fins are made of a shock absorbent material so that when the flying toy is operated in the second mode, the fins hamper a force associated with the spinning motion while the propeller assembly is received into the receptacle.

The propeller assembly has a first end, an opposing second end and a shaft connecting the first end to the second end, the shaft defining a spinning axis of the spinning motion, the first end having a plurality of blades to produce a propeller action in air associated with the spinning motion in order to maintain the propeller assembly in the air. The second end has an end coupler fixedly attached to the shaft, and a sleeve disposed over the end coupler, the sleeve independently rotatable relative to the shaft, and wherein the handle comprises a driving mechanism adapted to engage with the end coupler of the propeller assembly through the receptacle so that the driving mechanism causes the blades to spin when the flying toy is operated in the first mode. The driving mechanism comprises a driving coupler for providing mechanical coupling between the driving mechanism and the end coupler of the propeller assembly so as to cause the blades to spin when the driving mechanism is activated; and the handle further comprises a plurality of pinch rollers positioned in relationship to the driving coupler, the pinch rollers movable between a first position and a second position, such that when the driving mechanism is activated to cause the blades to spin through the coupling between the end coupler and the driving coupler, the pinch rollers are moved into the first position to engage with the conical sleeve in order to keep the propeller assembly in a stable position while the blades are spinning, and when the propeller assembly is ready to be launched, the pinch rollers are moved to the second position, allowing the propeller assembly to disengage from the driving mechanism and the landing platform.

It should be noted, in another embodiment of the present invention, the landing platform is removed from the handle. Only the pinch rollers in the first position are used to hold the bottom end of the propeller when the driving mechanism spins the blade prior to launching. When it is ready to launch the propeller assembly, the pinch rollers are moved to the second position.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A flying toy comprising:

a handle;

a propeller assembly;

a landing platform disposed on one side of the handle, wherein the landing platform comprises a receptacle for accommodating the propeller assembly, wherein the receptacle has a funnel-shape wall and a plurality of fins distributed around the wall, and wherein the funnel-shaped wall has a narrower end and an opposing wider end, and each of the fins comprises an elongated body, extending from the narrower end toward the wider end;

in a first mode to launch the propeller assembly off the landing platform while the propeller assembly is located in the receptacle, and in a second mode to receive the propeller assembly into the receptacle while the propeller assembly is in flight with a spinning motion, and wherein the fins are made of a shock absorbent material so that when the flying toy is operated in the second mode, the fins hamper a force associated with the spinning motion while the propeller assembly is received into the receptacle.

2. A flying toy comprising:

a handle;

a landing platform disposed on one side of the handle, wherein the landing platform comprises a receptacle for accommodating a propeller assembly, wherein the receptacle has a funnel-shaped wall and a plurality of fins distributed around the wall, wherein the flying toy is operable in a first mode to launch the propeller assembly off the landing platform while the propeller assembly is located in the receptacle, and in a second mode to receive the propeller assembly into the receptacle while the propeller assembly is in flight with a spinning motion, and wherein the fins are made of a shock absorbent material so that when the flying toy is operated in the second mode, the fins hamper a force associated with the spinning motion while the propeller assembly is received into the receptacle, and, wherein the propeller assembly has a first end, an opposing second end and a shaft connecting the first end to the second end, the shaft defining a spinning axis of the spinning motion, the first end having a plurality of blades to produce a propeller action in air associated with the spinning motion in order to maintain the propeller assembly in the air.

3. The flying toy of claim 2, wherein the second end has an end coupler fixedly attached to the shaft, and a sleeve disposed over the end coupler, the sleeve independently rotatable relative to the shaft, and wherein the handle comprises a driving mechanism adapted to engage with the end coupler of the propeller assembly through the receptacle so that the driving mechanism causes the blades to spin when the flying toy is operated in the first mode.

4. The flying toy of claim 3, wherein the handle has a battery chamber to accommodate one or more batteries for proving electrical power to the driving mechanism for launching the propeller assembly.

5. The flying toy of claim 3, wherein the sleeve of the propeller assembly has a conical shape, and wherein the driving mechanism comprises a driving coupler for providing mechanical coupling between the driving mechanism and the end coupler of the propeller assembly so as to cause the blades to spin when the driving mechanism is activated; and the handle further comprises a plurality of pinch rollers positioned in relationship to the driving coupler, the pinch rollers movable between a first position and a second position, such that when the driving mechanism is activated to cause the blades to spin through the coupling between the end coupler and the driving coupler, the pinch rollers are moved into the first position to engage with the conical sleeve in order to keep the propeller assembly in a stable position while the blades are spinning, and when the propeller assembly is ready to be launched, the pinch rollers are moved to the second position, allowing the propeller assembly to disengage from the driving mechanism and the landing platform.

6. A flying toy for launching a propeller assembly, the propeller assembly having a first end, an opposing second end and a shaft connecting the first end to the second end, the shaft defining a spinning axis, wherein the first end comprises a plurality of blades to produce a propeller action in air associated with a spinning motion along the spinning axis for keeping the propeller assembly in the air, the second end comprises an end coupler fixedly attached to the shaft, the propeller assembly further comprising a conical-shaped sleeve disposed over the end coupler, the sleeve independently rotatable relative to the shaft, said flying toy comprising:

a launching handle;

a driving mechanism disposed on the launching handle, the driving mechanism having a driving coupler adapted to engage with the end coupler of the propeller assembly for causing the blades to spin when the driving mechanism is activated;

a plurality of pinch rollers disposed on the launching handle around the driving coupler, the pinch rollers movable between a first position and a second position such that when the driving mechanism causes the blades to spin through the driving coupler, the pinch rollers are moved into the first position to engage with the conical-shaped sleeve in order to keep the propeller assembly in a stable position while the blades are spinning, and when the propeller assembly is ready to be launched, the pinch rollers are moved to the second position away from the conical-shaped sleeve, allowing the propeller assembly to disengage from the driving mechanism and the launching handle.

7. The flying toy of claim 6, wherein the launching handle further comprises a chamber to accommodate one or more batteries for providing electrical power to the driving mechanism.

8. The flying toy of claim 6, further comprising a platform disposed on the launching handle adjacent to the driving mechanism, the platform having a funnel-shaped receptacle with an aperture to accommodate the pinch rollers and the driving coupler so as to allow the second end of the propeller assembly to locate in the funnel-shaped receptacle when the end coupler of the propeller assembly is coupled to the driving coupler.

9. The flying toy of claim 6, further comprising:

a gear box having a first cover and a second cover, each cover having a plurality of linear slots accommodating the plurality of pinch rollers to allow the pinch rollers to move between the first position and the second position.

10. The flying toy of claim 9, further comprising:

a cam plate disposed in the gear box between the first cover and the second cover, the cam plate having a plurality of spiral shaped slots interacting with the linear slots, the cam plate having a home position, the plurality of pinch rollers disposed in the linear slots through the spiral shaped slots such that the pinch rollers are located at the second position when the cam plate is at the home position; and a rack movable between a first rack position for activating the driving mechanism and a second rack position for deactivating the driving mechanism, the rack coupled to the cam plate such that when the rack is moved from the second rack position to the first rack position, it causes the cam plate to rotate away from the home position, forcing the pinch rollers to move into the first position, and when the rack is moved from the first rack position back to the second position, it allows the cam plate to return to the home position and moves the pinch rollers to the second position.

* * * * *